United States Patent [19]

Poy et al.

[11] 4,007,306

[45] Feb. 8, 1977

[54] METHOD OF APPLYING AQUEOUS COATING COMPOSITIONS

[75] Inventors: George Lim Poy, Orchard Lakes, Mich.; Edward A. Sproul, Anaheim, Calif.

[73] Assignee: Inmont Corporation, New York, N.Y.

[22] Filed: Nov. 26, 1974

[21] Appl. No.: 527,393

[52] U.S. Cl. ..... 427/377; 260/29.4 UA; 260/856; 427/379; 427/421

[51] Int. Cl.[2] ..... B05D 3/02; B05D 1/02

[58] Field of Search ..... 427/388, 377, 421, 379; 260/556, 29.4 UA

[56] References Cited

UNITED STATES PATENTS

| | | | |
|---|---|---|---|
| 3,107,227 | 10/1963 | Suen | 260/856 |
| 3,218,280 | 11/1965 | Koral et al. | 260/856 X |
| 3,245,932 | 4/1966 | Glavis et al. | 260/856 X |
| 3,486,926 | 12/1969 | Rideout et al. | 427/421 X |
| 3,740,257 | 6/1973 | Roscher | 428/392 X |
| 3,821,145 | 6/1974 | Walus | 260/851 X |

FOREIGN PATENTS OR APPLICATIONS

| | | | |
|---|---|---|---|
| 676,155 | 12/1963 | Canada | 260/29.2 UA |

*Primary Examiner*—Harry J. Gwinnell

[57] ABSTRACT

Aqueous coating compositions containing dissolved reactive acrylic copolymers and aminoplast resins are disclosed. The pigmented coatings are especially useful for topcoat enamels for automobiles. A method for applying coatings to automobiles is also disclosed comprising spraying the coating composition in a relative humidity of 40 to 60% followed by heating the wet coated surface to remove the volatile components and then heating to cure the coating.

16 Claims, No Drawings

METHOD OF APPLYING AQUEOUS COATING COMPOSITIONS

This invention relates to aqueous coating compositions and particularly to such compositions that are useful as topcoat finishes for automobiles.

It has been recognized heretofore that the use of water as a volatile solvent in coating compositions has many advantages such as low cost, non-toxicity, odorlessness and non-inflammability. Also, coatings containing water as the major volatile component would meet the requirements of the most strict of the anti-pollution regulations, such as Los Angeles' Rule 66. The use of water as a solvent in coating compositions that have to be baked to cure them has many disadvantages however. Among these disadvantages is the fact that more heat is required to evaporate water than for any of the organic solvents and this results in a necessity to allow more time or use higher temperatures to evaporate the solvent. In automobile topcoat finishing it has not been practical heretofore to use a topcoat finish containing water as the principal solvent. Because such topcoat finishes are usually baked in order to obtain acceptable resistance properties, the use of water as the solvent in baking finishes has resulted in solvent popping, or boiling, when traces of solvent are left in the film during later stages of the baking, or thermosetting of the film. This solvent "popping" results in an undesirable rough, uneven surface. A further disadvantage in use of water based finishes is that it has not been possible heretofore to produce a gloss finish that is acceptable for automobile topcoat finishes.

A main object of the present invention is to produce a thermosetting paint or finish that is suitable for use as an automobile topcoat finish. A further object of the invention is to provide a practical method for applying topcoat finishes to automobiles using aqueous compositions. Other objects of the invention will be apparent from the detailed description of the invention.

In accordance with the invention, an aqueous coating composition is prepared using a particular type of cross-linkable acrylic compolymer dissolved in water as its water soluble salt, especially its ammonium or amine salt. Preferably the coating will also contain a water compatible aminoplast resin as a cross-linking agent. Advantageously, the coating compositions contain pigments and such aqueous enamels are very desirable for use as thermosetting enamel topcoats for automobiles. Preferably, the coating compositions will contain minor amounts of readily volatile, water miscible, organic solvents such as ketones, alcohols, esters, glycols and glycol ethers. In general the coating composition will contain 0 to 20% by weight pigment, 10 to 32% by weight of cross-linkable acrylic copolymer, 3 to 16% by weight water compatible cross-linking agent, 4 to 25% by weight of volatile, water-miscible organic solvent, a basic solubilizing compound for the acrylic copolymer in an amount sufficient to solubilize the copolymer at a pH of 7 to 12, and water in an amount up to as high as 88% by weight. Preferably the coating composition will contain small amounts of other conventional additives such as anti-foaming agents, anti-settling agents, biocides, leveling agents, etc.

The cross-linkable acrylic copolymer, which is an important and essential component in the aqueous coating composition, must contain hydroxyl groups and carboxyl groups, must have a molecular weight of 2,000 to 100,000 (as determined by light scattering methods or by membrane osmometry), must have a glass transition temperature (Tg) of + 20° C. to + 80° C., and must have an acid number of 30 to 120. The copolymer is made by solution copolymerization of a mixture of monomers consisting of 60 to 86.5%, by weight of a $C_1$ to $C_4$ alkyl acrylate or methacrylate, styrene, vinyl toluene, or diacetone acrylamide, 5 to 34%, by weight of a reactive monomer of the group consisting of hydroxyethyl, hydroxypropyl and glycidyl esters of acrylic and methacrylic acids, 0.5 to 6%, of an alpha, beta ethylenically unsaturated nitrile, especially acrylonitrile, and 5 to 18.5%, by weight of an $\alpha$, B-unsaturated carboxylic acid of the group consisting of acrylic acid, methacrylic acid, maleic anhydride and fumaric acid.

An especially preferred group of cross-linkable acrylic copolymers are those as defined above which contain no more than about 15% of methyl methacrylate. The copolymers which do not contain methyl methacrylate, or only a small amount of methyl methacrylate, give baked pigmented coatings having better gloss than do coatings made from copolymers having larger amounts of methyl methacrylate. Copolymers containing a small amount of acrylonitrile, or similar unsaturated nitrile, are preferred because they facilitate easier application, a higher quality finish and are more readily soluble in water to form stable coatings. Other commercially available $\alpha$, B-ethylenically unsaturated nitriles include methacrylonitrile and vinylidene dinitrile.

Preferably the copolymer is made by solution polymerization using conventional addition polymerization catalysts such as azoisobutyronitrile, t-butyl peroctoate, benzoyl peroxide, etc., and chain transfer agents such as dodecyl mercaptan, methallyl chloride, etc. Advantageously, the copolymerization is carried out in a water miscible solvent which becomes part of the coating vehicle formulation, i.e., it is not necessary to separate the polymer in solid form before using it in the coating composition. Solvents which are commonly used in coating compositions are preferably used, such as $C_1$ to $C_{10}$ alcohols, acetone, methyl ethyl ketone, methyl isobutyl ketone, cyclohexanone, butyl acetate, methyl acetate, Cellosolve, carbitol, butyl Cellosolve, methyl carbitol, butyl carbitol, and combinations thereof. It is of course necessary that the solvent be volatile under the conditions normally used for baking the coating.

The cross-linkable acrylic copolymer is solubilized in the aqueous coating composition by reacting it with ammonia or a volatile amine. Examples of volatile amines include: a triethyl amine, dimethylaminoethanol, and morpholine. Such basic solubilizing reagent is used to solubilize the copolymer at a pH of 7 to 12, preferably 7 to 9. The preferred solubilizing reagents are ammonia and the readily volatile amine because they will be evaporated from the film during baking to cure the coating.

Although cross-linking agents are not essential for obtaining a cross-linked film, they are preferred because they enhance such important properties as gloss retention, and antichalking under many weather conditions. Aminoplast cross-linking agents are preferred. Aminoplast cross-linking agents which are operable include conventional water compatible aminoplast resin, especially the urea-formaldehyde and melamine-formaldehyde types. Especially preferred are the methyl ethers of melamine-formaldehyde condensates such as hexamethoxymethyl malamine and realated types, commercially available as Resimene 745, Resimene 755, Cymel 300, Cymel 301 and Cymel 303. It is preferable to use a melamine resin that cross-links at a higher temperature so that it is possible to evaporate substantially all of the volatile components of the film before the cross-linking reaction begins. This is believed to be essential to prevent formation of a rough, uneven, baked film.

Pigments used in the aqueous coating composition are those conventionally used in the industry and are selected on the basis of their suitability to produce the desired end result. Typical pigments that are used in automobile finishes are operable, for instance, and include such pigments as phthalocyanine blue, phthalocyanine green, B.O.N. red pigments, quinacridone pigments, Indanthrene Blue, Thio-indigo red, Indo orange and red, benzidene yellow, carbon black, titanium dioxide, iron oxide, Siennas, cadmium red, lead chromate, molybdate orange, metal flake, etc. Transparent dyes, such as rhodamine, Victoria Blue, methyl violet, etc. may also be used.

Another factor contributing to the success of the invention is the relatively low glass transition temperature of the cross-linkable acrylic copolymer. The Tg of the polymer must be low enough to promote more efficient "reflow" of the copolymer film just prior to, or during, cross-linking to produce surface smoothness, thus enhancing the gloss and luster of the final paint film. The glass transition temperature of the polymer is on the order of +20° C. to +80° C. Glass transition temperature as used herein refer to the calculated value using the equation $$\frac{1}{T_g} = \frac{W_1}{T_{g_1}} + \frac{W_2}{T_{g_2}} \cdots \frac{W_n}{T_{g_n}}$$

where $W_1$, $W_2$ - - - $W_n$ are the weight fractions of acrylic monomer in the copolymer, Tg is the glass transition temperature of the copolymer, and $T_{g_1}$, $T_{g_2}$ - - - $T_{g_n}$ are the glass transition temperatures of the corresponding homopolymers in degrees Kelvin in accordance with the prior art, e.g. Fox, Bulletin American Phys. Society, No. 3, 1956.

A further important aspect of the invention is the type and amount of volatile organic solvent employed. Although volatile water-miscible solvents in general can be used in the invention, it has been discovered that the properties of the final cured paint film are affected by the particular types and amounts of solvents used. For instance, for obtaining optimum metallic appearance in a metallic finish such as that of Example 2, it appears to be essential that at least 40% of the volatile water-miscible organic solvent be made up of an alcohol, ester, or ketone, or mixtures thereof having a boiling point of 80° C. to 115° C., especially 85° C. to 105° C., a flash point of 70° F. to 110° F., especially 85° F. to 105° F., and form an azeotrope with water that boils at a temperature below the boiling point of water, e.g. 70° to 99° C., preferably 80° to 99° C. N-Propyl alcohol is especially preferred as such a solvent.

Minor amounts of other volatile, water-miscible, organic solvents are operable and desirable as components of the solvent mixture. For example, minor amounts, as illustrated in the Examples, of high boiling solvents such as 2-ethoxy ethanol-1 (Cellosolve), 2-butoxy-ethanol-1 (Butyl Cellosolve), diethylene glycol mono ethyl ether (Carbitol), and the like are desirable as minor components because they tend to be the last solvents removed from the driving film and thus keep the film open to permit the lower boiling solvents to evaporate more readily.

It is apparent that the evaporation of the solvents from a film of enamel containing such a multi-component solvent system is a complicated phenomenon because of the possibility of the formation of various bi-, tri, and tetra-component azeotropes. In any event, however, it appears necessary that the major portion of the volatile water-miscible solvent should boil below the boiling point of water on, at least form an azeotrope which boils below the boiling point of water, e.g. 70° to 99° C., especially 80° to 99° C.

Other optional components in the aqueous enamel may include conventional additives such as anti-foam agents, anti-settling agents, biocides, leveling agents, stabilizers or inhibitors and surfactants. Typical commercial anti-foam agents are: Byk H-36 (sold by Byk-Gulden, Inc.), Dapto 880 (sold by Daniel Products), Troy Kyd Defoamer (sold by Troy Chemical), and Mil foam no. 7 (sold by Naftone). Typical commercial anti-settling agents include: Bentones, Atta gel 50, and Benagel E.W. A typical biocide is Dowacide a (sold by Dow Chemical).

Usually the film-forming resin system used in the novel aqueous coatings will require a catalyst, or curing accelerator, for optimum curing. Conventional catalysts known to those skilled in the art are operable, such as citric acid, p-toluene sulfonic acid, methyl p-toluene sulfonate, butyl phosphoric acid, etc.

The aqueous coating compositions of this invention must be cured at temperatures above about 300° F. The selection of particular temperatures and curing times is well within the skill of those skilled in the art. Use of these temperatures has the additional advantage of allowing evaporation of the water before cross-linking of the film, as earlier described herein. To avoid surface disruptions which may be caused by too rapid heating of the film, it is normally desirable to evaporate a considerable proportion of the water before beginning to cure the film. This is typically done by allowing the film to air dry at ambient conditions for a few minutes and then heating the film at about 190° F. for a period of about 6 to 10 minutes. Use of such an evaporation period and the relation of particular temperatures and time periods is well within the skill of those skilled in the art.

The following examples in which the parts are by weight are given to further illustrate the invention:

EXAMPLE 1

To a suitable reaction vessel equipped with an agitator, reflux condenser, inert gas inlet, and temperature control devices, charge a mixture of 528 parts n-propyl alcohol, 207 parts of methyl ethyl ketone and 310 parts of butyl Cellosolve. Heat the organic solvent mixture to about 104° C. under agitation and add 551 parts of butyl methacrylate, 665 parts of styrene, 285 parts of butyl acrylate, 247 parts of methacrylic acid, 152 parts of hydroxyethyl methacrylate, 20 parts of acrylonitrile, 60 parts of t-butyl peroctoate and 5 parts of dodecyl mercaptan over a period of 150 minutes. Hold at 100° C. for an additional 120 minutes and then remove from the reaction vessel. Solids content is 63.15%. The acid number is 78-82 based on non-volatiles and the viscosity is 20,000 centipoises at 77° F.

A white automotive topcoat enamel is prepared using 25.70% of the above copolymer solution, 6.78% of water compatible melamine-formaldehyde resin (e.g. Monsanto's Resimene 755), 1.37% of dimethyl ethanol amine, 51.12% distilled or deionized water, 1.80% butyl carbitol, 2.18 n-propyl alcohol, 0.05% phthalocyanine blue, 0.01% carbon black, 10.93% titanium dioxide pigment, 0.015% DC200 silicone fluid, and 0.025% of methyl p-toluene sulfonate curing accelerator. The enamel was reduced with 10% deionized water for spray application at a viscosity of 50-80 centipoises. The enamel is sprayed using conventional spray equipment, (e.g. Binks 62 Gun, 63C fluid tip, 363 needle, 63 PB or 63 PR Air Gap) at a flow rate of 18–20 oz./min., atomization pressure of 80-85 p.s.i. and a pot pressure of 7–8 p.s.i. Multiple spray passes were made on a primed steel surface to build up a film thickness of 1.4–1.7 mils (dry). There was approximately one minute between spray passes and each pass of the spray deposited an amount of coating equivalent to about 0.4 mil (dry) thickness. A time of about 10 minutes is allowed after the last pass of the spray before baking the film (10 minutes at 190° F. followed by 20 minutes at 325° F.). Relative humidity throughout the coating process should preferably be maintained at 40% to 60% for best results at ambient temperature of about 75° F., although other conditions in the ranges of 45° to 90° F. and 10 to 90% relative humidity can be used. The baked coating has a hardness of 14 to 18 Knoop, a 20° gloss of 75, and has excellent weather resistance properties.

It is important to note that the above topcoat enamel, which is typical of the invention, contains less than 20% of volatile organic solvents. It is, therefore, within compliance with the more strict anti-pollution requirements, such as California's Rule 66.

EXAMPLE 2

A blue metallic automotive topcoat enamel is prepared using 29.35% of the copolymer solution of Example 1, 7.73% Resimene 755, 1.58% dimethyl ethanolamine, 56.06% of distilled or deionized water, 1.92% butyl carbitol, 1.99% n-propyl alcohol, 0.87 aluminum flake pigment, 0.41% phthalocyanine blue pigment, 0.04% carbon black, 0.01 titanium dioxide, 0.015% DC200 silicone fluid and 0.025% methyl p-toluene sulfonate. The enamel was reduced to spray viscosity with 10% deionized water and sprayed onto primed steel as in Example 1. The cured film had properties similar to that of Example 1 except that it was a blue metallic finish rather than a white.

EXAMPLE 3

Example 1 was repeated except that the topcoat enamel was applied as two coats, each approximately 1 mil thick (dry) and each coating was cured separately. The cured coating had properties similar to those in Example 1.

Other acrylic copolymers which have been prepared in a manner similar to that in Examples and which are operable in the invention include:

Copolymer A - Butyl methacrylate 27.62 %, styrene 34.54%, butyl acrylate 14.79%, methacrylic acid 13.19%, hydroxypropyl methacrylate 8.84% and acrylonitrile 1.02%. Tg of the copolymer is 59.2° C. Acid No. 86 (theoretical).

Copolymer B - Butyl methacrylate 28.6%, styrene 34.6%, butyl acrylate 14.9%, methacrylic acid 12.9%, hydroxyethyl acrylate 8.0% and acrylonitrile 1.0%. Tg of the copolymer is 39.2° C. and Acid No. is 84 (theoretical).

Copolymer C - Butyl methacrylate 26.5%, styrene 34.5%, butyl acrylate 14.8%, methacrylic acid 12.8%, hydroxyethyl methacrylate 10.4%, and acrylonitrile 1.0%. Tg of the copolymer is 47° C. and Acid No. is 83 (theoretical).

Copolymer D - Butyl acrylate 33.7%, styrene 34.7%, methacrylic acid 18.5%, hydroxyethyl methacrylate 12.1% and acrylonitrile 1.0%. Tg of the copolymer is 33.6° C. and Acid No. is 120 (theoretical).

Copolymer E - Butyl methacrylate 20.3%, styrene 34.7%, butyl acrylate 14.9%, methacrylic acid 15.1%, hydroxyethyl methacrylate 14.0% and acrylonitrile 1.0%. Tg of the copolymer is 51° C. and Acid No. is 98 (theoretical).

Copolymer F - Butyl methacrylate 25.5%, styrene 34.7%, hydroxyethyl acrylate 33.7%, methacrylic acid 5.1% and acrylonitrile 1.0%. Tg of the copolymer is 35° C. and Acid No. is 33 (theoretical).

Copolymer G - Butyl methacrylate 28.6%, styrene 34.6%, butyl acrylate 14.9%, methacrylic acid 12.9%, hydroxypropyl acrylate 8% and acrylonitrile 1.0%. Tg of the copolymer is 40.2° C. and Acid No. 84 (theoretical).

Copolymer H - Butyl methacrylate 54.13%, styrene 17.15%, methacrylic acid 7.43%, hydroxyethyl methacrylate 16.22%, and acrylonitrile 5.07%. The copolymer had a Tg of 19.5° C. and Acid No. 40 (theoretical).

It is to be noted that although styrene appears in all of the specific examples of copolymers indicating that it is a preferred monomer, this preference for styrene as a monomer is due not only to the properties it imparts to the coating, e.g. gloss and hardness, but also it has historicially been one of the least expensive monomers that can be used.

What is claimed is:

1. A method of applying coatings to automobiles comprising:

a. spraying the automobile in a relative humidity throughout the coating process of 40 to 60% with an aqueous thermosetting coating composition having a threshold cross-linking temperature above 300° F. and comprised of:

A. 0 to 20% pigment,

B. 3 to 16% water compatible aminoplast cross-linking agent,

C. 4 to 25% volatile water miscible organic solvent which forms an azeotrope with water which boils at 70°– 99° C., D. 10 to 32% of a water soluble acrylic copolymer having a Tg of 20° C. to 80° C., a molecular weight of 2,000 to 100,000, said copolymer being the copolymerization product of (a) 60 to 86.5% by weight of at least one monomer of the group consisting of 1–4 carbon alkyl acrylates, 1–4carbon alkyl methacrylates, styrene, vinyl toluene, and diacetone acrylamide; (b) 5.0 to 34% by weight of a reactive monomer of the group consisting of hydroxyethyl, hydroxypropyl and glycidyl esters of acrylic and methacrylic acids; (c) 0.5 to 6% by weight of an $\alpha$, B-ethylenically unsaturated nitrile, and (d) 5 to 18% by weight of an $\alpha$, B-unsaturated carboxylic acid of the group consisting of acrylic acid, methacrylic acid, maleic anhydride and fumaric acid, E. an acrylic copolymer solubilizing reagent of the group consisting of ammonia and volatile amines, in an amount sufficient to solubilize the acrylic copolymer at a pH of 7 to 12 and F. water, b. heating the wet coated surface at a temperature below the threshold cross-linking temperature of the coating to remove substantially all of the volatile components before appreciable cross-linking begins and c. then heating the coating above 300° F. until the coating is cured.

2. A method as in claim 1 wherein the aqueous coating is applied by multiple passes of the spray gun to build up a cured film thickness of 1.4 to 1.7 mils.

3. A method as in claim 2 wherein heating step (b) consists of heat at about 190° F. for about 10 minutes and heating step (c) consists of heating at a temperature of about 20 minutes at about 325° F.

4. A method as in claim 1 wherein the compatible aminoplast is a melamine formaldehyde resin, the acrylic copolymer solubilizing agent is a volatible base, and the acrylic copolymer contains less than 15% of methyl methacrylate.

5. A method as in claim 4 wherein the α, B-ethylenically unsaturated nitrile is acrylonitrile.

6. A method as in claim 4 wherein at least 50% of the water miscible solvent in the coating composition is comprised of solvents which form azeotropes with water which boil at a temperature of 70° C. or above but below the boiling point of water.

7. A method as in claim 6 wherein the α, B-ethylenically unsaturated nitrile is acrylonitrile.

8. A method as in claim 7 wherein the major portion of the solvent boiling below the boiling point of water is n-propyl alcohol.

9. A method of applying coating to automobiles comprising:

a. spraying the automobile in a relative humidity throughout the coating process of 40 to 60% with an aqueous thermosetting coating composition having a threshold cross-linking temperature above 300° F. and consisting of non-volatile components and volatile components, the non-volatile components comprising A. 0 to 50% pigment B. 50 to 100% non-volatile vehicle comprising:

1. 15 to 45% water compatible aminoplast cross-linking agent and 2. 55 to 85% of a water soluble acrylic copolymer having a Tg of 20° to 80° C., a molecular weight of 2,000 to 100,000, said copolymer being the 2. copolymerization product of (a) 60 to 85.6%, by weight, of at least one monomer of the group consisting of 1–4 carbon aklyl acrylates, 1–4 carbon alkyl methacrylates, styrene, vinyl toluene and diacetone acrylamide, (b) 5 to 34% of a reactive monomer of the group consisting of hydroxyethyl, hydroxypropyl and glycidyl esters of acrylic and methacrylic acids, (c) 0.5 to 6.0%, by weight, of an α, B-ethylenically unsaturated nitrile, and (d) 5 to 18.5%, by weight of an α, B-unsaturated carboxylic acid of the group consisting of acrylic acid, methacrylic acid, maleic anhydride and fumaric acid, and the volatile components of said composition comprising C. 4 to 25% water miscible organic solvent which forms an azeotrope with water which boils at 70° to 99° C., D. an acrylic copolymer solubilizing reagent of the group consisting of ammonia, and volatile amines, in an amount sufficient to solubilize the acrylic copolymer at a pH of 7 to 12 and E. water b. heating the wet coated surface at a temperature below the threshold cross-linking temperature of the coating to remove substantially all of b. the volatile components before appreciable cross-linking begins and c. then heating the coating above 300° F. until the coating is cured.

10. A method as in claim 9 wherein the aqueous coating composition is applied by multiple passes of the spray gun to build up a cured film thickness of 1.4 to 1.7 mils.

11. A method as in claim 10 wherein heating steps (b) consists of heating at about 190° F. for about 10 minutes and heating step (c) consists of heating at a temperature of about 325° F. for about 20 minutes.

12. A method as in claim 9 wherein the aminoplast is a melamine formaldehyde resin and the acrylic copolymer contains less than 15% of methyl methacrylate.

13. A method as in claim 12 wherein the α, B-ethylenically unsaturated nitrile is acrylonitrile.

14. A method as in claim 12 wherein at least 50% of the water miscible solvent in the coating composition is comprised of solvents which form azeotropes with water which boil at a temperature of 70° C. or above but below the boiling point of water.

15. A method as in claim 14 wherein the α, B-ethylenically unsaturated nitrile is acrylonitrile.

16. A method as in claim 15 wherein the major portion of the solvent boiling below the point of water is n-propyl alcohol.

* * * * *